US008911166B2

(12) United States Patent
Tsukada

(10) Patent No.: US 8,911,166 B2
(45) Date of Patent: Dec. 16, 2014

(54) CUTTING DEVICE AND PRINTER WITH A CUTTING DEVICE

(75) Inventor: Toshihiro Tsukada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 793 days.

(21) Appl. No.: 12/827,552

(22) Filed: Jun. 30, 2010

(65) Prior Publication Data

US 2011/0008091 A1 Jan. 13, 2011

(30) Foreign Application Priority Data

Jul. 13, 2009 (JP) ..... 2009-164532

(51) Int. Cl.

| | |
|---|---|
| ***B41J 11/70*** | (2006.01) |
| ***B26D 1/08*** | (2006.01) |
| *B26D 1/30* | (2006.01) |
| *B26D 7/00* | (2006.01) |
| *B26D 1/00* | (2006.01) |
| *B26D 5/14* | (2006.01) |

(52) U.S. Cl.

CPC ..... *B41J 11/70* (2013.01); *B26D 1/305* (2013.01); *B26D 7/00* (2013.01); *B41J 11/703* (2013.01); *B26D 2001/0053* (2013.01); *B26D 1/085* (2013.01); *B26D 1/0006* (2013.01); *B26D 5/14* (2013.01)

USPC ..... 400/621; 83/694

(58) Field of Classification Search

USPC ..... 400/621, 621.1; 83/139, 166, 694

See application file for complete search history.

(56) References Cited

U.S. PATENT DOCUMENTS

| | | | | |
|---|---|---|---|---|
| 5,468,081 | A * | 11/1995 | Cane et al. | 400/621 |
| 5,538,591 | A * | 7/1996 | Collins et al. | 156/759 |
| 6,508,600 | B1 | 1/2003 | Nonaka | |
| 8,562,229 | B2 * | 10/2013 | Inaba et al. | 400/621 |
| 2005/0036820 | A1 | 2/2005 | Watanabe et al. | |
| 2007/0119317 | A1 * | 5/2007 | Takagi | 101/227 |
| 2007/0296799 | A1 | 12/2007 | Watanabe et al. | |

FOREIGN PATENT DOCUMENTS

| | | | | |
|---|---|---|---|---|
| JP | 899289 | A | 4/1996 | |
| JP | 2001-293266 | * | 10/2001 | B26B 9/00 |
| JP | 2001-341932 | * | 12/2001 | B65H 35/08 |
| JP | 2003-025274 | * | 1/2003 | B26D 1/08 |
| JP | 2004-298989 | * | 10/2004 | B26D 1/30 |
| JP | 200559395 | A | 3/2005 | |
| JP | 3800891 | B2 | 7/2006 | |
| JP | 2007-044837 | * | 2/2007 | B26D 7/08 |
| JP | 2008110455 | A | 5/2008 | |

* cited by examiner

*Primary Examiner* — Leslie J Evanisko
*Assistant Examiner* — Marissa Ferguson Samreth
(74) *Attorney, Agent, or Firm* — Lowe Hauptman & Ham, LLP

(57) ABSTRACT

A cutting device and a printer having a cutting device eliminate paper jams and other transportation problems that can occur as a result of the cutting device cutting the paper, and can cut and reliably discharge the paper in a stable condition. The cutting device has a fixed knife 21, a transportation path 13 through which label paper 11 is conveyed, and a movable knife 22 that moves bidirectionally to the fixed knife 21 and cuts the label paper 11 on the upstream side of the fixed knife 21 on the transportation path 13. A catching unit 22*b* is disposed to the surface of the movable knife 22 on the upstream side of the transportation path 13, and catches the cut end of the label paper 11 after the movable knife 22 moves to the fixed knife 21 side and cuts the label paper 11.

24 Claims, 6 Drawing Sheets

CUTTING DEVICE AND PRINTER WITH A CUTTING DEVICE

This application claims priority under 35 U.S.C. §119 to Japanese Patent Application No. 2009-164532 filed on Jul. 28, 2009, the entire disclosure of which is expressly incorporated by reference herein.

BACKGROUND

1. Technical Field

The present invention relates to a cutting device and to a printer having a cutting device that cuts paper or other medium placed or passed between the cutting edges of a fixed knife and a movable knife by moving the movable knife to the fixed knife and sliding the cutting edge of the movable knife along the cutting edge of the fixed knife.

2. Related Art

Printers that print on continuous paper such as roll paper or label paper often have a cutting device for cutting off the printed portion of the paper. The cutting device is located at the downstream end of the transportation path that goes to the paper exit passed the printing position of the print head (that is, near the paper exit), and the cut-off portion of the paper is discharged from the paper exit. Such cutting devices include scissor cutters that cause the movable knife to pivot to and away from the fixed knife, and sliding cutters that move the movable knife bidirectionally in a straight line to and away from the fixed knife.

A printer having a cutting device is taught in Japan Patent No. 3800891. The cutting device used in said printer has a fixed knife that is disposed on the printer frame side, and a movable knife that is disposed on the main cover side. When this cover is closed, the movable knife is set to a position opposite the fixed knife with the transportation path therebetween, and is configured to move freely bidirectionally relative to the fixed knife and cut paper in cooperation with the fixed knife. The cutting device also has a drive means that causes the movable knife to move bidirectionally.

When the movable knife cuts the paper while moving to the fixed knife side in a cutting device having a movable knife and a fixed knife on opposite sides of the transportation path for conveying the paper as described above, the leading end in the transportation direction of the paper that is left in the printer (that is, the end of the paper on the side that was not cut off and becomes the leading end after the paper is cut) may also be carried with the movement of the movable knife in the direction of movable knife movement and be left in contact with the fixed knife instead of returning to its original position. When cutting is finished and the movable knife then returns to its home position, the end of the paper that should be positioned in the transportation path may remain in contact with the fixed knife. If the paper is then advanced from this position for printing, for example, paper transportation will start with the end of the paper outside of the transportation path and touching the fixed knife. The paper will therefore not be conveyed through the transportation path and a paper jam or other paper conveyance problem may result.

It is also possible to reverse the paper after cutting so that the leading end of the paper separates from contact with the fixed knife. However, if the paper is thus reversed, the curled end of the paper may arch and contact the print head, thus possibly soiling the paper or adversely affecting the print head. Controlling returning the paper to the original position when the paper is retracted after cutting is also complicated, is time-consuming, and adding such control increases the cost.

SUMMARY

A cutting device and a printer having a cutting device according to at least of one embodiment of the present invention eliminates paper jams and other transportation problems that can occur when the cutting device cuts the paper, and can reliably convey the paper on the printer side in a stable condition after the paper is cut.

A cutting device according to a first aspect of the invention has a fixed knife; a transportation path through which paper is conveyed; a movable knife that is disposed to the transportation path on the upstream side of the fixed knife, moves relative to the fixed knife, and cuts paper in the transportation path in cooperation with the fixed knife; and a catching unit that is disposed to the movable knife at a position on the upstream side of the transportation path and catches an end part of the paper after the paper is cut.

When the movable knife moves to the fixed knife side and cuts the paper in the transportation path in a cutting device according to this aspect of the invention, even if the leading end in the transportation direction of the cut paper (the end of the paper) is carried by the movable knife, it rides over the catching unit of the movable knife and is positioned where it can be picked up by the catching unit. When the movable knife then returns from this position to the original position and separates from the fixed knife, the end of the paper is caught by the catching unit and moves with the movable knife away from the fixed knife. When the movable knife returns to its home position opposite the fixed knife, the catching unit passes over and disengages from the end of the paper, and the end of the paper can return to the transportation path.

As a result, even if the end of the paper is carried by the movable knife when the paper is cut, the end of the paper will not be left touching the fixed knife and can be returned to the transportation path. Transportation problems such as paper jams caused by the end of the paper remaining in contact with the fixed knife and being advanced without having returned to the transportation path can thus be easily eliminated without additional complicated control and increased cost, and the paper can be consistently and reliably discharged after being cut.

In a cutting device according to another aspect of the invention, the catching unit is a protrusion disposed to the movable knife.

The cutting device according to this aspect of the invention can reliably catch the end of the paper by means of the catching unit rendered by a protrusion, and leaving the cut end of the paper touching the fixed knife can be avoided.

In a cutting device according to another aspect of the invention, the catching unit is a shoulder disposed to the movable knife.

The cutting device according to this aspect of the invention can reliably catch the end of the paper by means of the catching unit rendered by a shoulder, and leaving the cut end of the paper touching the fixed knife can be avoided.

In a cutting device according to another aspect of the invention, the catching unit is a roughened portion of the surface of the movable knife.

The cutting device according to this aspect of the invention can reliably catch the end of the paper by means of the catching unit rendered by a roughened surface area, and leaving the cut end of the paper touching the fixed knife can be avoided.

In a cutting device according to another aspect of the invention, the catching unit is a surface with greater friction than the surface of the movable knife.

The cutting device according to this aspect of the invention can reliably catch the end of the paper by means of the catching unit rendered by a high friction surface, and leaving the cut end of the paper touching the fixed knife can be avoided.

In a cutting device according to another aspect of the invention, the catching unit is disposed so that when the movable knife separates from the fixed knife and returns after the movable knife moves to the fixed knife side and cuts the paper, the catching unit can catch the end of the paper.

When the movable knife of the cutting device according to this aspect of the invention returns, the catching unit can reliably catch and return the end of the paper, and leaving the cut end of the paper touching the fixed knife can be avoided.

In a cutting device according to another aspect of the invention, the catching unit is disposed to a position where it passes over the end of the cut paper when the movable knife moves to the fixed knife side and cuts the paper, and catches the cut end of the paper when the movable knife then separates from the fixed knife and returns.

With the cutting device according to this aspect of the invention, the catching unit reliably catches the end of the paper when the catching unit returns, and can avoid leaving the cut end of the paper touching the fixed knife.

Another aspect of the invention is a printer with a cutting device, the printer having a print process unit that prints on paper, and a cutting device as described above that cuts the paper printed by the print process unit.

A printer with a cutting device according to this aspect of the invention can cut and discharge the printed paper without paper jams or other transportation problems.

Other objects and attainments together with a fuller understanding of the invention will become apparent and appreciated by referring to the following description and claims taken in conjunction with the accompanying drawings.

DESCRIPTION OF EMBODIMENTS

A cutting device and a printer with a cutting device according to preferred embodiments of the present invention are described below with reference to the accompanying figures.

Figure 1A:
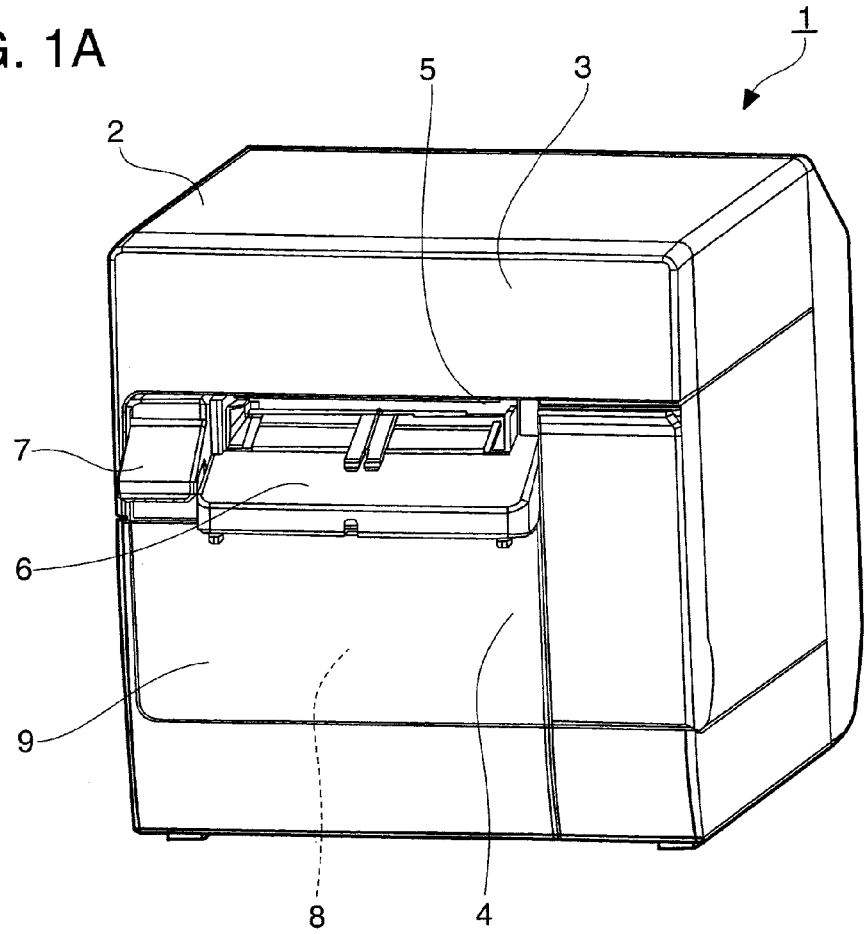
FIG. 1A is an oblique view of a printer with a cutting device according to a preferred embodiment of the invention.

As shown in FIG. 1A, the printer with cutting device 1 has a printer housing 2 having a generally rectangular box-like shape. The front of the printer housing 2 is covered by a top case 3 and a bottom case 4, and has a rectangular paper exit 5 of a specific width formed therebetween. A paper exit guide 6 protrudes to the front below the paper exit 5, and an opening/closing lever 7 is disposed beside the paper exit guide 6. An opening to a roll paper compartment 8 formed inside the printer housing 2 is formed in the bottom case 4 below the paper exit guide 6 and opening/closing lever 7, and this opening is closed by an access cover 9. When the opening/closing lever 7 is operated and the access cover 9 opened, roll paper 10 can be loaded into the roll paper compartment 8.

Various types of paper can be used as the roll paper 10, including roll paper having a continuous web of paper of a specific width wound into a roll, rolls of label paper having labels of a predetermined shape (die-cut labels) affixed at a predetermined interval on the surface of a continuous web liner of a predetermined width, and rolls of label paper having a continuous web of label stock of a predetermined width affixed to the surface of a continuous web liner of a predetermined width (continuous label paper).

Figure 1B:
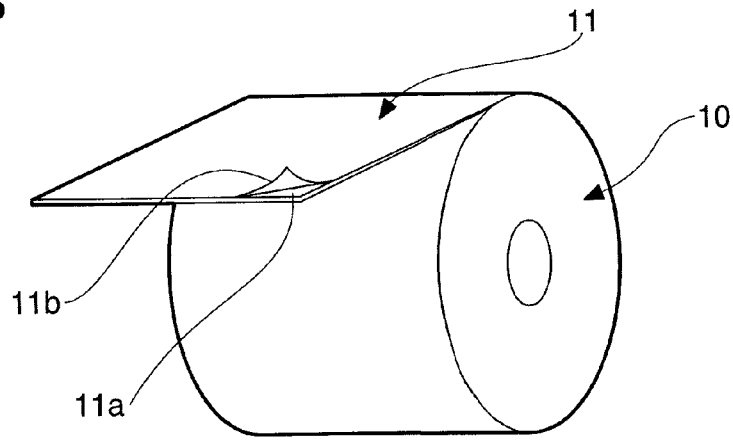
FIG. 1B is an oblique view of roll paper.

As shown in FIG. 1B, this embodiment of the invention uses label paper 11 having a continuous label (or butt-cut labels) 11*b* affixed to the web liner 11*a* wound into a roll.

Figure 2:
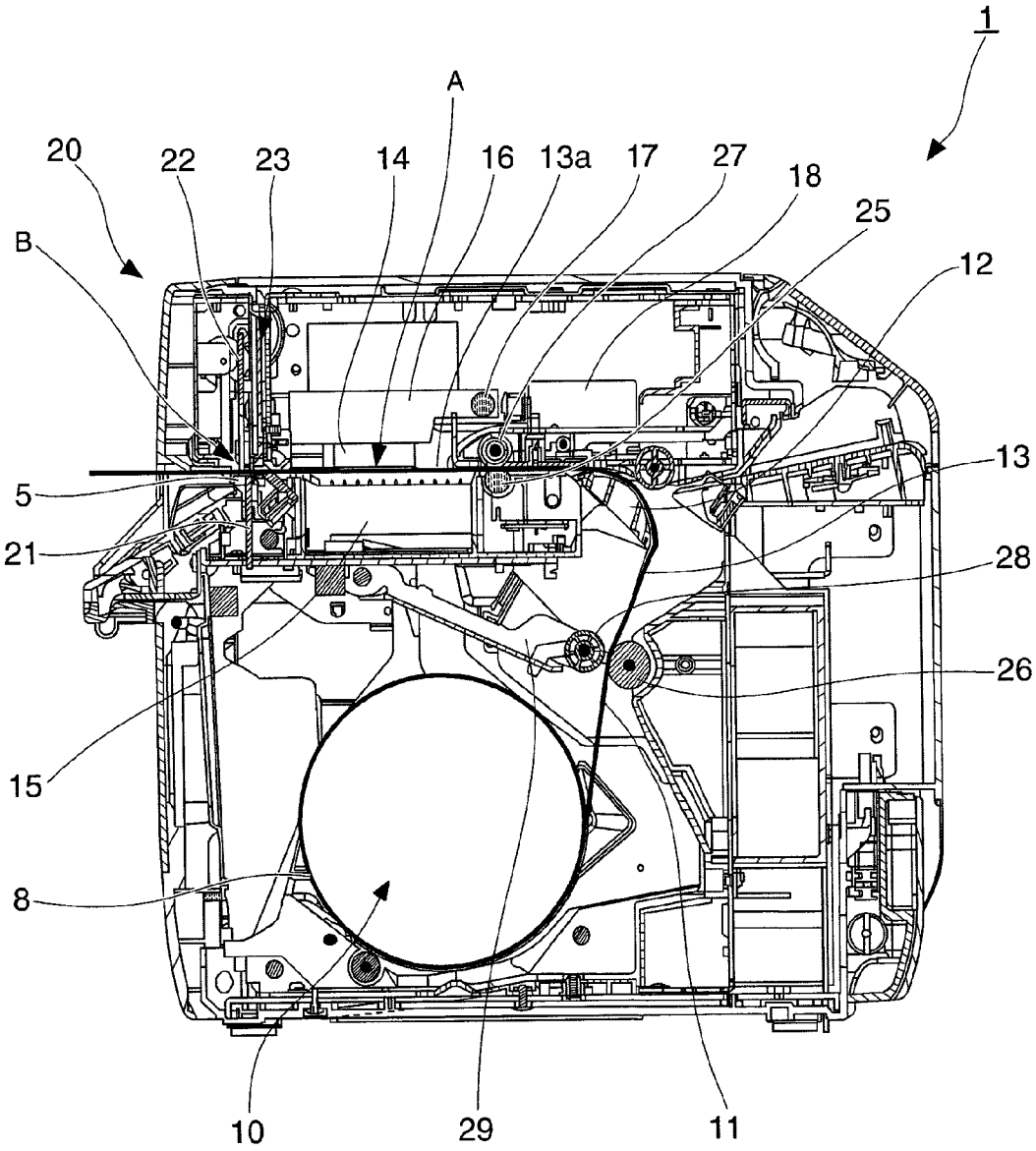
FIG. 2 is a section view showing the configuration of the inside of the printer with a cutting device shown in FIG. 1A.

As shown in FIG. 2, the roll paper compartment 8 is formed in the center between the side walls of the printer housing 2 inside the printer with cutting device 1. The roll paper 10 is stored in the roll paper compartment 8 with the roll paper 10 resting on its side horizontally with its axis widthwise to the printer.

The label paper 11 web delivered from the roll paper 10 loaded in the roll paper compartment 8 is pulled diagonally upward, then curves around a curved tension guide 12, and is then conveyed through a transportation path 13 that extends horizontally to the paper exit 5. The tension guide 12 is urged upward by the force of a spring, and a specific tension is applied to the label paper 11 passing around the tension guide 12.

The horizontal portion of the transportation path 13 is directly above the roll paper compartment 8. An inkjet print head (print process unit) 14 and vacuum platen (platen) 15 are disposed in mutual opposition with a specific gap therebetween in this horizontal transportation path portion 13*a*, and the printing position A of the inkjet print head 14 is determined by the vacuum platen 15. The inkjet print head 14 is carried on a carriage 16, and the carriage 16 is moved bidirectionally widthwise to the printer along a carriage guide shaft 17 by means of a carriage motor 18.

A cutting position B is disposed downstream from a printing position A. The cutting device 20 is disposed to cutting position B, and the label paper 11 printed at the printing position A is cut widthwise at cutting position B.

The cutting device 20 includes a fixed knife 21 disposed with the cutting edge facing up, a movable knife 22 disposed with the cutting edge facing down, and a movable knife drive mechanism 23. The paper exit 5 of the cutting device 20 is the paper exit 5 of the printer with cutting device 1. The fixed knife 21 and the movable knife 22 are disposed so that the cutting direction is aligned with the printer width (the paper width). The movable knife 22 is disposed on the upstream side of the transportation path 13, the fixed knife 21 is disposed on the downstream side, and the paper exit 5 is on the downstream side of the fixed knife 21.

The transportation mechanism for conveying the label paper 11 along the transportation path 13 includes a paper feed roller 25, a delivery roller 26, and a paper feed motor and delivery motor for rotationally driving these rollers. The paper feed roller 25 is located on the upstream side of the printing position A on the transportation path 13, and is rotationally driven by a paper feed motor. A first pressure roller 27 is pressed against and rotates in conjunction with the paper feed roller 25.

The delivery roller 26 is for supplying label paper 11 from the roll paper compartment 8, and is located on the transportation path 13 on the upstream side in the paper transportation direction from the tension guide 12. The delivery roller 26 is rotationally driven by a delivery motor not shown, and a second pressure roller 28 is pressed against and rotates in conjunction with the delivery roller 26. The second pressure roller 28 is attached to a distal end part of a pressure lever 29 that extends toward the back from a position below the vacuum platen 15. This pressure lever 29 is pushed down by the force of a spring, and is urged to the delivery roller 26.

The label paper 11 pulled from the roll paper 10 in the roll paper compartment 8 is conveyed by the transportation mechanism through the transportation path 13. The inkjet print head 14 prints on the label side of the paper at the printing position A. The cutting device 20 cuts the label paper 11 so that the cut-off portion 11*c* contains the printed area. A label of a desired length is thus issued from the paper exit 5.

Cutting Device

Figure 3:
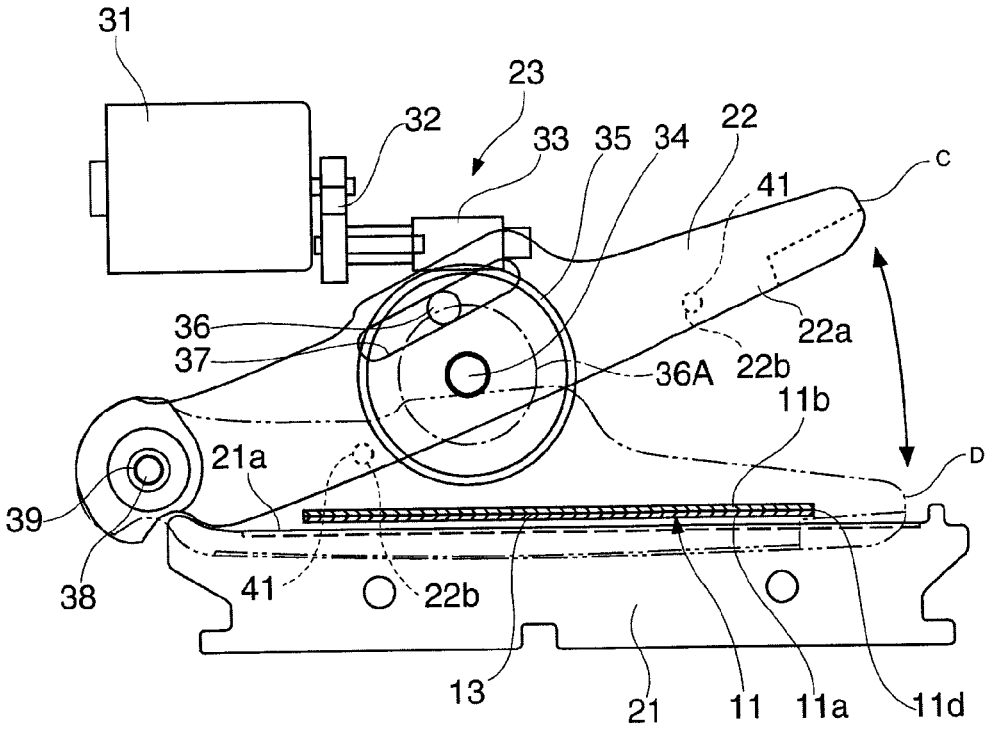
FIG. 3 is a front view showing the configuration of the cutting device from the downstream side of the transportation path.
Figure 4:
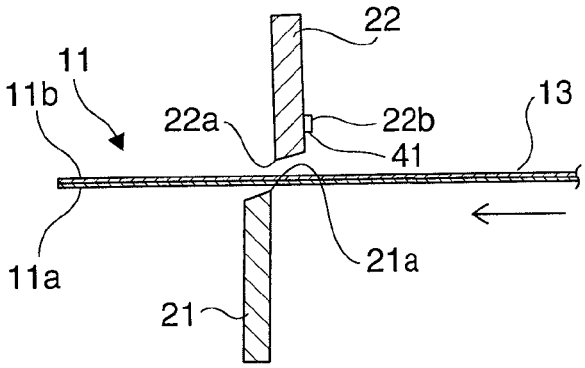
FIG. 4 is a section view showing the configuration of the cutting device.

FIG. 3 is a schematic view of the fixed knife 21, movable knife 22, and movable knife drive mechanism 23 of the cutting device 20.

The cutting device 20 is a scissor cutter. The paper transportation path 13 is formed and the label paper 11 passes between the cutting edge 22*a* of the movable knife 22 and the cutting edge 21*a* of the fixed knife 21.

Torque from a cutter motor 31 causes the movable knife 22 to pivot up and down on a pivot axis at one end thereof widthwise to the printer in the range of movement between a standby position C (home position, the position denoted by the solid line in FIG. 3) where a specific gap is formed between the cutting edge 22*a* of the movable knife 22 and the cutting edge 21*a* of the fixed knife 21, and a cutting-completed position D (denoted by the imaginary line in FIG. 3) where the cutting edge 22*a* of the movable knife 22 and the cutting edge 21*a* of the fixed knife 21 overlap throughout the entire range thereof widthwise to the printer (the cutting direction).

The movable knife drive mechanism 23 has a worm gear 33 that is rotationally driven by the cutter motor 31 through a power transfer mechanism 32. The worm gear 33 meshes with a worm wheel 35 that is affixed to rotate freely on a support shaft 34. The rotational motion of the worm wheel 35 is converted by a crank mechanism to the vertical bidirectional motion of the movable knife 22.

The crank mechanism includes a crank pin 36 attached perpendicularly to the round end face of the worm wheel 35 at a position offset from the axis of rotation, and a straight slide channel 37 of a specific length formed in the movable knife 22. The crank pin 36 is inserted so that it can slide in the slide channel 37, and rotates along a circular path of rotation 36A denoted by the dot-dash line in FIG. 3 in conjunction with rotation of the worm wheel 35.

The length of the slide channel 37 is set so that it can move tracking the movement of the crank pin 36 vertically and widthwise to the printer, and the movable knife 22 can pivot vertically on the support shaft 38 on which one end thereof is supported as the pivot axis.

A coil spring 39 that pushes the movable knife 22 to the fixed knife 21 is disposed to the support shaft 38, and the compression force between the cutting edge 22*a* of the movable knife 22 and cutting edge 21*a* of the fixed knife 21 is held to or greater than the compression force required to cut the label paper 11 by means of the urging force of this coil spring 39.

When the worm wheel 35 turns one revolution, the movable knife 22 travels once back and forth between the standby position C and the cutting-completed position D, and can cut the label paper 11 disposed between the movable knife 22 and the fixed knife 21 across the width of the paper.

A plurality of catching units 22*b* are disposed on the side of the movable knife 22 on the upstream side of the transportation path 13. These catching units 22*b* are rendered by protrusions 41 formed on the movable knife 22, and are disposed to the movable knife 22 with gaps therebetween across the printer width.

Note that the fixed knife 21 is attached to the access cover 9 of the bottom case 4, and moves in front of the printer housing 2 together with the access cover 9 when the access cover 9 opens. The movable knife 22 is disposed on the top case 3 side. Therefore, when the access cover 9 is opened and the roll paper 10 is loaded, the label paper 11 can be easily pulled from the roll paper 10 between the fixed knife 21 and the movable knife 22.

Cutting and Discharging the Label Paper

Figure 5A:
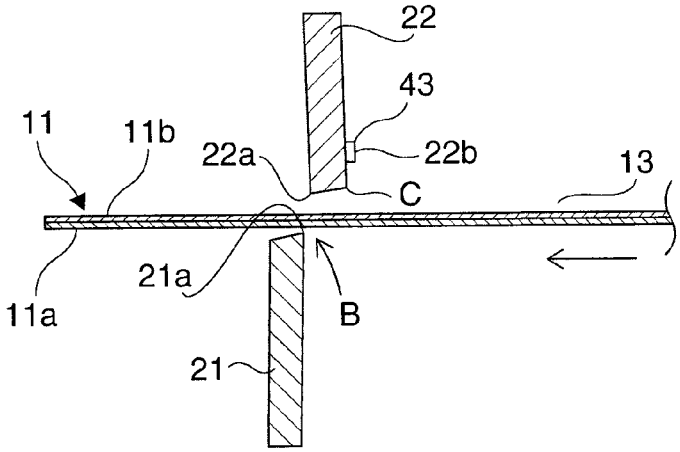
FIG. 5A is a section view of the cutting device before the movable knife moves and before the label paper is cut.
Figure 5B:
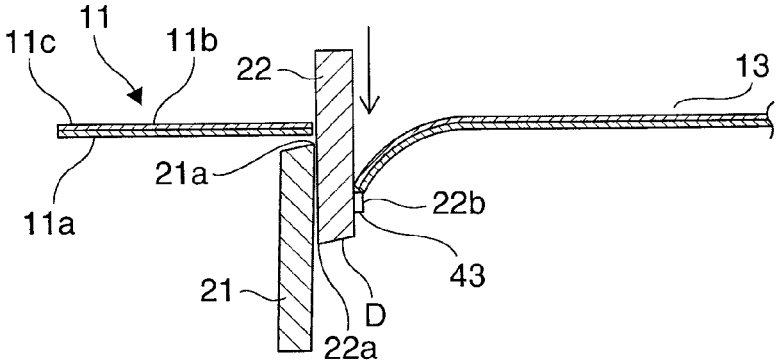
FIG. 5B is a section view of the cutting device when the movable knife moves and cuts the label paper.
Figure 5C:
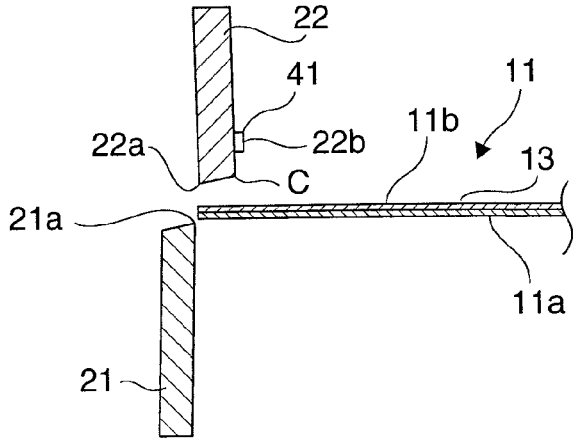
FIG. 5C is a section view of the cutting device when cutting the label paper is finished and the movable knife has retracted.

Cutting and discharging the label paper 11 from the paper exit 5 is described next with reference to FIG. 5. FIG. 5A is a section view of the cutting device before the label paper is cut, and schematically shows the label paper 11 as it passes cutting position B. FIG. 5B is a section view schematically showing the label paper 11 when it is cut. FIG. 5C is a section view schematically showing the cutting device when the movable knife has retracted after cutting the label paper 11.

As shown in FIG. 5A, the label paper 11 is conveyed in the direction of the arrow to the cutting position after being printed at the printing position A. When printing labels, the label paper 11 is conveyed by the transportation mechanism until the printed label is positioned on the downstream side of the cutting position B so that the liner is cut between the labels.

When transportation stops, the movable knife 22 moves in the direction of the arrow from the standby position C to the end-of-cutting position D as shown in FIG. 5B. As a result, the intersection with the cutting edge 21*a* of the fixed knife 21 moves from one edge to the other edge widthwise to the printer, thus cutting the part of the label paper 11 positioned between the knives, and the cut-off portion 11*c* is discharged from the paper exit 5.

When the movable knife 22 moves down to the end-of-cutting position D when cutting the label paper 11, the leading end of the label paper 11 in the transportation direction is carried with the movable knife 22 while touching the movable knife 22. The catching units 22*b* rendered by the protrusions 41 disposed to the movable knife 22 then move passed the edge of the leading end of the label paper 11 and move below the edge of the label paper 11, that is, down in the direction of movable knife 22 travel. FIG. 5B shows the catching units 22*b* after they have passed over the end of the label paper 11.

More specifically, the stroke of the movable knife 22 when cutting the paper is at least long enough that the edge of the label paper 11 rides over the catching units 22*b*.

When cutting is completed and the movable knife 22 returns to the standby position C, the edge of the label paper 11 is caught by the catching units 22*b* of the movable knife 22 as shown in FIG. 5C, is moved to the standby position C side of the movable knife 22 in conjunction with movable knife 22 movement, and then rides over the catching units 22*b* of the movable knife 22 and separates from the catching units 22*b*.

As a result, the end of the label paper 11 is not left pushed down to the fixed knife 21 side and touching the fixed knife 21, and instead is positioned in the transportation path 13 between the cutting edge 21*a* of the fixed knife 21 and the cutting edge 22*a* of the movable knife 22.

Therefore, when the label paper 11 is next conveyed by the transportation mechanism, the label paper 11 is fed smoothly along the transportation path 13 to the paper exit 5 instead of contacting the fixed knife 21 and causing a paper jam or other transportation problem.

As described above, when the movable knife 22 moves to the fixed knife 21 side and cuts the label paper 11 in the transportation path 13 in the cutting device according to this embodiment of the invention, the cut edge of the label paper 11 is picked up by the catching units 22*b* of the movable knife 22. When the movable knife 22 then returns and separates from the fixed knife 21, the edge of the label paper 11 is held by the catching units 22*b* and moves with the movable knife 22 in the direction separating from the fixed knife 21 and thus returns to the transportation path 13. As a result, leaving the end of the label paper 11 touching the fixed knife 21 after being cut can be avoided. Paper jams and other transportation problems caused by the end of the label paper 11 not returning to the transportation path 13 and the label paper 11 being advanced while touching the fixed knife 21 can be eliminated without inviting a cost increase by changing transportation control, for example, and the label paper 11 can be cut and consistently discharged reliably.

A printer with the cutting device described above can also cut and discharge printed label paper 11 without such transportation problems as a paper jam.

While the embodiment described above has a plurality of protrusions 41 formed on the movable knife 22 as the catching units 22*b*, the number of protrusions 41 rendering the catching unit 22*b* may be one or three or more. The catching unit 22*b* may further alternatively be rendered by a continuous protruding rib running widthwise to the printer.

Yet further, catching units 22*b* rendered by protrusions 41 are disposed to the movable knife 22 in the embodiment described above by way of example only, but the catching units 22*b* are not limited to such protrusions 41 and the catching units 22*b* may be rendered by shoulders formed on the movable knife 22.

Figure 6:
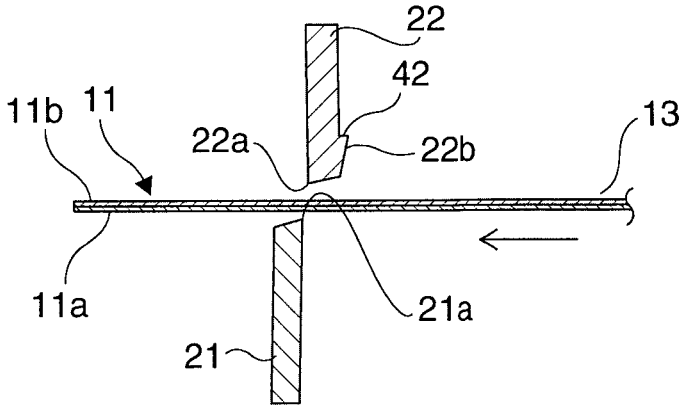
FIG. 6 is a section view of the cutting device having a movable knife with a catching unit rendered by a shoulder.

FIG. 6 shows an example of a catching unit 22*b* rendered by a shoulder 42 on the movable knife 22. Note that when a catching unit 22*b* rendered by this shoulder 42 is used, a wedge shape that narrows toward the tip of the cutting edge 22*a* is preferred so that when the movable knife 22 moves toward the end-of-cutting position D, the end of the label paper 11 is guided smoothly to the catching unit 22*b* rendered by the shoulder 42.

Figure 7:
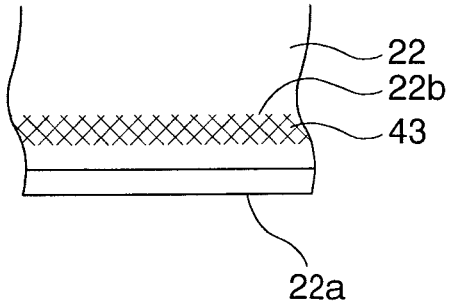
FIG. 7 is a plan view of a movable knife having a catching unit rendered by a high friction surface.

Yet further, if the edge of the label paper 11 can be caught, the catching unit 22*b* may be rendered as shown in FIG. 7 by knurling, satinizing, or otherwise roughening the surface of the label paper 11 to render a high friction surface 43 with greater frictional resistance to the end of the label paper 11 than the rest of the surface of the movable knife 22. The catching unit 22*b* may also be a high friction surface 43 rendered by applying a high friction sheet, for example.

When the catching unit 22*b* is rendered by a shoulder 42 or a high friction surface 43 formed on the movable knife 22, the end of the label paper 11 can be reliably caught and the end of the label paper 11 being left touching the fixed knife 21 after the paper is cut can be avoided.

Yet further, the fixed knife 21 and movable knife 22 are disposed substantially horizontally in the foregoing embodiment, but the fixed knife 21 and movable knife 22 are not limited to a horizontal arrangement.

Other Embodiments

A cutting device according to another embodiment of the invention is described next. This embodiment is described as having a catching unit rendered by a protrusion disposed to the movable knife.

Figure 8:
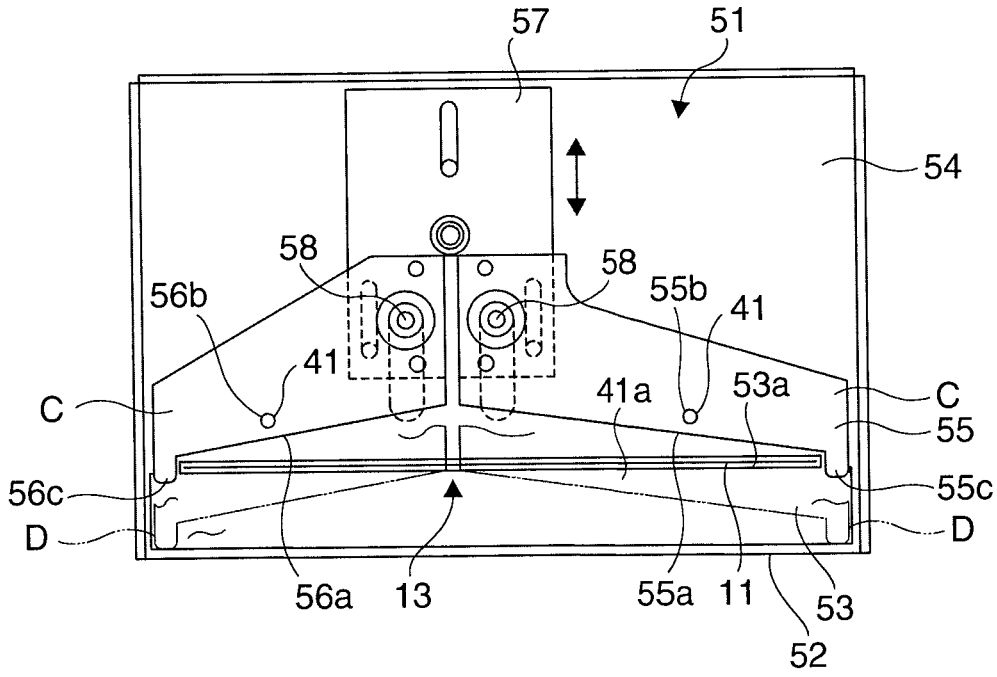
FIG. 8 is a front view of another example of a cutting device from the upstream side of the transportation path.

FIG. 8 is a front view of a cutting device disposed in a printer.

As shown in FIG. 8, the cutting device 51 has a fixed knife 53 fastened to a frame 52, and a first movable knife 55 and a second movable knife 56 disposed to a cover 54, and the first movable knife 55 and the second movable knife 56 slide linearly bidirectionally to and away from the fixed knife 53.

The first and second movable knives 55, 56 are substantially triangularly shaped, and are located opposite the fixed knife 53 with the label paper 11 transportation path 13 therebetween. An uncut part is left near the center of the label paper 11 in this embodiment of the invention, and a gap is therefore provided between the first movable knife 55 and the second movable knife 56.

A protruding finger 55*c*, 56*c* is formed at the end of the first and second movable knives 55, 56, respectively. These fingers 55*c*, 56*c* normally rest on the fixed knife 53 and guide the movement of the first and second movable knives 55, 56.

The cutting edges 55*a*, 56*a* of the first and second movable knives 55, 56 are formed with a bevel of a specific angle to the cutting edge 53*a* of the fixed knife 53. The gap between the cutting edge 53*a* of the fixed knife 53 and the fingers 55*c*, 56*c* of the first and second movable knives 55, 56 increases from the ends of the fixed knife 53 to the center. As a result, the cutting edges 55*a*, 56*a* of the first and second movable knives 55, 56 form a basic V-shape to the cutting edge 53*a* of the fixed knife 53.

A sliding plate 57 that can slide vertically is disposed between the first and second movable knives 55, 56. This sliding plate 57 is connected to the first and second movable knives 55, 56 through intervening pusher pins 58. The sliding plate 57 is made to slide up and down in the direction of the arrow by a drive mechanism including a drive motor and a torque transfer mechanism not shown.

When the sliding plate 57 slides vertically, the first and second movable knives 55, 56 move bidirectionally relative to the fixed knife 53 as the sliding plate 57 slides.

The cutting device 51 according to this embodiment of the invention also has catching units 55*b*, 56*b* rendered by protrusions 41 on the surfaces of the first and second movable knives 55, 56 on the upstream side in the transportation direction of the label paper 11.

When the sliding plate 57 is driven in the direction of the arrow by the drive mechanism in this embodiment of the invention, the first and second movable knives 55, 56 move from the standby position C toward the end-of-cutting position D, and cut across the width of the label paper 11 at the part positioned between the fixed knife 53 and the first and second movable knives 55, 56.

When the first and second movable knives 55, 56 move down to the end-of-cutting position D when cutting the label paper 11, the catching units 55*b*, 56*b* rendered by the protrusions 41 disposed to the first and second movable knives 55, 56 pass over the end of the label paper 11 and are positioned below the end of the label paper 11, that is, forward in the direction of travel of the first and second movable knives 55, 56.

More specifically, the stroke of the first and second movable knives 55, 56 when cutting the paper is at least long enough that the edge of the label paper 11 rides over the catching units 55*b*, 56*b*.

When the first and second movable knives 55, 56 then return to the standby position C, the edge of the label paper 11 is caught by the catching units 55*b*, 56*b* of the first and second movable knives 55, 56, is moved to the standby position C side of the first and second movable knives 55, 56 in conjunction with the movement of the movable knives 55, 56, and then rides over and separates from the catching units 55*b*, 56*b* of the first and second movable knives 55, 56.

As a result, the end of the label paper 11 is not left touching the fixed knife 53, and instead is positioned in the transportation path 13 between the cutting edge 53*a* of the fixed knife 53 and the cutting edges 55*a*, 56*a* of the first and second movable knives 55, 56.

Therefore, when the label paper 11 is next conveyed by the transportation mechanism, the label paper 11 is fed smoothly to the paper exit 5 instead of contacting the fixed knife 53 and causing a paper jam or other transportation problem. In other words, the label paper 11 can be cut and consistently discharged reliably.

Note that the foregoing embodiment is described as having first and second movable knives 55, 56, but the movable knife may be a single knife extending widthwise to the printer.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A cutting device, comprising:

a fixed blade;

a conveying path through which a sheet is to be conveyed; and a movable blade disposed on an upstream side of the fixed blade with respect to the conveying path, facing the fixed blade across the conveying path, and configured to move relative to the fixed blade in a reciprocal manner to cut the sheet in cooperation with the fixed blade, wherein the movable blade includes a catching unit disposed at a position on an upstream side of the movable blade with respect to the conveying path and configured to catch an end portion of the sheet upon separation of the movable blade from the fixed blade after cutting the sheet.

2. The cutting device described in claim 1, wherein the catching unit is a protrusion disposed on the movable blade.

3. The cutting device described in claim 1, wherein:

the catching unit is a shoulder disposed on the movable blade.

4. The cutting device described in claim 1, wherein:

the catching unit is a roughened portion of a surface of the movable blade.

5. The cutting device described in claim 1, wherein:

the catching unit is a surface with greater friction than that of a surface of the movable blade.

6. The cutting device described in claim 1, wherein:

the movable blade is configured to move bidirectionally relative to the fixed blade.

7. The cutting device described in claim 1, wherein:

the catching unit is disposed so that when the movable blade separates from the fixed blade and returns after cutting the sheet, the catching unit catches the end portion of the sheet.

8. The cutting device described in claim 1, wherein:

the catching unit is disposed at a position where the catching unit passes over the end portion of the sheet after the movable blade cuts the sheet, and catches the end portion of the sheet when the movable blade then returns after cutting.

9. The cutting device described in claim 1, wherein the movable blade slides against a non-cutting surface of the fixed blade during movement relative to the fixed blade in the reciprocal manner.

10. The cutting device described in claim 1, wherein a longitudinal axis of the movable blade remains at least substantially parallel to a longitudinal axis of the fixed blade during movement relative to the fixed blade in the reciprocal manner.

11. The cutting device described in claim 1, wherein the cutting device cuts the sheet into cut sheet segments, the sheet being located upstream of the cutting device and respective cut sheet segments being located downstream of the cutting device after respectively cutting the sheet to create respective cut sheet segment.

12. The cutting device described in claim 1, wherein the catch unit is configured to catch a first end portion of the sheet that is located upstream from a second end portion of a cut segment of sheet, wherein the first end portion and the second end portion are established as end portions of the respective sheet and cut segment of sheet as a result of the same cutting action.

13. A printer, comprising:

a print process unit configured to print on a sheet; and a cutting device configured to cut the sheet, the cutting device including a fixed blade;

a conveying path through which a sheet is to be conveyed; and a movable blade disposed on an upstream side of the fixed blade with respect to the conveying path, facing the fixed blade across the conveying path, and configured to move relative to the fixed blade in a reciprocal manner to cut the sheet in cooperation with the fixed blade, wherein the movable blade includes a catching unit disposed at a position on an upstream side of the movable blade with respect to the conveying path and configured to catch an end portion of the sheet upon separation of the movable blade from the fixed blade after cutting the sheet.

14. The printer described in claim 13, wherein:

the catching unit is a protrusion disposed on the movable blade.

15. The printer described in claim 13, wherein:

the catching unit is a shoulder disposed on the movable blade.

16. The printer described in claim 13, wherein:

the catching unit is a roughened portion of a surface of the movable blade.

17. The printer described in claim 13, wherein:

the catching unit is a surface with greater friction than that of a surface of the movable blade.

18. The printer described in claim 13, wherein:

the movable blade is configured to move bidirectionally relative to the fixed blade.

19. The printer described in claim 13, wherein:

the catching unit is disposed to catch the end portion of the sheet when the moveable blade returns after cutting the sheet.

20. The printer described in claim 13, wherein:

the catching unit is disposed at a position where the catching unit passes over the end portion of the sheet after the movable blade cuts the sheet, and catches the end portion of the sheet when the movable blade then returns after cutting.

21. The cutting device described in claim 13, wherein the movable blade slides against a non-cutting surface of the fixed blade during movement relative to the fixed blade in the reciprocal manner.

22. The cutting device described in claim 13, wherein a longitudinal axis of the movable blade remains at least substantially parallel to a longitudinal axis of the fixed blade during movement relative to the fixed blade in the reciprocal manner.

23. The cutting device described in claim 13, wherein the cutting device cuts the sheet into cut sheet segments, the sheet being located upstream of the cutting device and respective cut sheet segments being located downstream of the cutting device after respectively cutting the sheet to create respective cut sheet segment.

24. The cutting device described in claim 13, wherein the catch unit is configured to catch a first end portion of the sheet that is located upstream from a second end portion of a cut segment of sheet, wherein the first end portion and the second end portion are established as end portions of the respective sheet and cut segment of sheet as a result of the same cutting action.

* * * * *